US010652665B2

(12) United States Patent
Chen

(10) Patent No.: US 10,652,665 B2
(45) Date of Patent: May 12, 2020

(54) SYMMETRICAL DUAL-EDGE LOUDSPEAKER

(71) Applicant: Tymphany Acoustic Technology (Huizhou) Co., Ltd., Huizhou, Guangdong Province (CN)

(72) Inventor: Zhi Chen, Huizhou (CN)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/402,775

(22) Filed: May 3, 2019

(65) Prior Publication Data

US 2019/0342669 A1 Nov. 7, 2019

(30) Foreign Application Priority Data

May 4, 2018 (CN) ..... 2018 2 0656848 U

(51) Int. Cl.
*H04R 7/18* (2006.01)
*H04R 9/06* (2006.01)
(Continued)

(52) U.S. Cl.
CPC ..... *H04R 9/06* (2013.01); *H04R 7/122* (2013.01); *H04R 7/127* (2013.01); *H04R 7/18* (2013.01); *H04R 9/025* (2013.01); *H04R 31/003* (2013.01); *H04R 2231/003* (2013.01); *H04R 2307/207* (2013.01); *H04R 2400/11* (2013.01)

(58) Field of Classification Search
CPC ..... H04R 7/127; H04R 7/18; H04R 9/025; H04R 9/043; H04R 9/06; H04R 31/003; H04R 2231/003; H04R 2307/207; H04R 2400/11
USPC ..... 381/398, 403, 404, 405, 423, 424, 430, 381/432, 433; 181/171, 172
See application file for complete search history.

(56) References Cited

U.S. PATENT DOCUMENTS 6,031,925 A * 2/2000 Shteyn ..... H04R 9/063 381/401
6,490,363 B1 * 12/2002 Liu ..... H04R 9/06 381/403

(Continued)

*Primary Examiner* — Huyen D Le
(74) *Attorney, Agent, or Firm* — Muncy, Geissler, Olds & Lowe, P.C.

(57) ABSTRACT

The invention provides a symmetrical dual-edge loudspeaker, comprising a frame and a cone paper, a U-shaped magnet and a voice coil mounted in the frame, wherein an accommodation chamber is formed in the middle of the U-shaped magnet; the voice coil is located in the accommodation chamber; the cone paper comprises a body and an upper edge and a lower edge bonded to the upper and lower sides of the body; the upper edge and the lower edge respectively protrude upwards and downwards, forming a symmetrical structure; the cone paper is fixedly connected to the frame via the upper edge and the lower edge; and the lower edge is provided with an air discharge hole. The invention effectively ensures steady up and down motion of the cone paper by disposing up-down symmetrical upper and lower edges, and enables a stiffness coefficient Kms to achieve optimal symmetry, thus satisfying an application requirement for an ultra-thin loudspeaker.

10 Claims, 7 Drawing Sheets

(51) Int. Cl.

| | |
|---|---|
| ***H04R 31/00*** | (2006.01) |
| ***H04R 7/12*** | (2006.01) |
| ***H04R 9/02*** | (2006.01) |

(56) References Cited

U.S. PATENT DOCUMENTS

| | | | | |
|---|---|---|---|---|
| 6,526,151 | B1 * | 2/2003 | Peng | H04R 9/06 181/171 |
| 2005/0141746 | A1 * | 6/2005 | Kobayashi | H04R 9/041 381/424 |
| 2016/0119717 | A1 * | 4/2016 | Jensen | H04R 7/18 181/172 |

* cited by examiner

SYMMETRICAL DUAL-EDGE LOUDSPEAKER

TECHNICAL FIELD

The invention relates to the technical field of loudspeakers, in particular to a symmetrical dual-edge loudspeaker.

BACKGROUND

A conventional loudspeaker generally comprises a frame, a cone paper, a voice coil, a damper and a magnetic assembly; and a suspension system thereof mainly consists of a cone edge and a damper combination. Such a design can better ensure the cone paper not to easily sway during up and down motions, can avoid the bad phenomenon caused by abnormal noises, and can improve product stability to a great extent.

In the design of a mini-loudspeaker, the damper design is canceled. Instead, a magnetic solution is injected into a gap between magnets to steady the center of the voice coil and achieve high product stability.

However, in an ultra-thin loudspeaker, under the situation that BL (a driving force parameter) is required to be satisfied, the space for designing an edge and a damper is small. If a conventional suspension structure is adopted, then the stiffness coefficient Kms cannot achieve optimal symmetry.

Therefore, the existing loudspeaker structure is required to be optimized to enable the existing loudspeaker structure to satisfy the application requirement for an ultra-thin loudspeaker.

SUMMARY OF THE INVENTION

To solve the above-described problem in the prior art, the invention provides a loudspeaker with two symmetrical edges; a cone paper thereof is connected to a frame via an upper edge and a lower edge which are symmetrical to realize up and down motions, thus satisfying motion stability of the product.

To achieve the above object, the invention provides the following technical solution:

A symmetrical dual-edge loudspeaker, comprising a frame and a cone paper, a U-shaped magnet and a voice coil mounted in the frame, wherein an accommodation chamber is formed in the middle of the U-shaped magnet; the voice coil is located in the accommodation chamber; the cone paper comprises a body and an upper edge and a lower edge bonded to the upper and lower sides of the body; the upper edge and the lower edge respectively protrude upwards and downwards, forming a symmetrical structure; the cone paper is fixedly connected to the frame via the upper edge and the lower edge; and the lower edge is provided with an air discharge hole.

The upper edge of the cone paper protrudes upwards, and the lower edge protrudes downwards, forming a symmetrical structure; one ends of the upper and lower edges are connected to the body of the cone paper, and the other ends are connected to the frame. The loudspeaker can effectively improve the vibration efficiency of the cone paper by disposing up-down symmetrical upper and lower edges.

As a further description to the technical solution of the invention, the position on the lower edge at which the air discharge hole is disposed comprises: one side adjacent to the body, the middle of the lower edge and one side adjacent to the frame.

As a further description to the technical solution of the invention, the body is an integrated structure or a split structure.

As a further description to the technical solution of the invention, the frame comprises an upper frame portion and a lower frame portion; the upper edge, the lower edge and the upper frame portion are integrally formed, thus the installation size of the loudspeaker can be reduced.

As a further description to the technical solution of the invention, the U-shaped magnet comprises a peripheral portion in a split structure and a central portion; the peripheral portion and the lower frame portion are integrally injection-molded.

As a further description to the technical solution of the invention, the shape of the upper edge and the lower edge is a ring, a triangle, a square or a polygon.

With the above-described technical solution, the invention achieves the following technical effects:

The invention effectively ensures steady up and down motion of the cone paper in a limited suspension space by disposing up-down symmetrical upper and lower edges, and enables the stiffness coefficient Kms to achieve optimal symmetry, thus satisfying an application requirement for an ultra-thin loudspeaker.

DETAILED DESCRIPTION OF THE EMBODIMENTS

To facilitate the understanding of the invention, the invention will be comprehensively described hereafter in connection with the drawings and specific embodiments. The drawings provide preferred embodiments of the invention. However, the invention can be realized in various different forms, but not limited to the embodiments described herein. On the contrary, the embodiments are provided with the purpose of more thoroughly and comprehensively understanding the disclosures of the invention.

It should be noted that when an element is "fixed on" another element, the element can be directly fixed on another element or can also be fixed on an intermediate element; and when an element is "connected to" another element, element can be directly connected to another element or can also be connected to an intermediate element.

To facilitate reading, locality nouns "upper", "lower", "left" and "right" are used according to the drawings, with the purpose of pointing out reference relative positions of various elements, but not for limiting the present application.

Unless otherwise defined, all of the technical and scientific terms used in the text have the same meanings as that a person skilled in the art generally understands. In the text, the terms used in the specification of the invention are only used to describe specific embodiments, but not intended to limit the invention.

Embodiment 1

Figure 1:
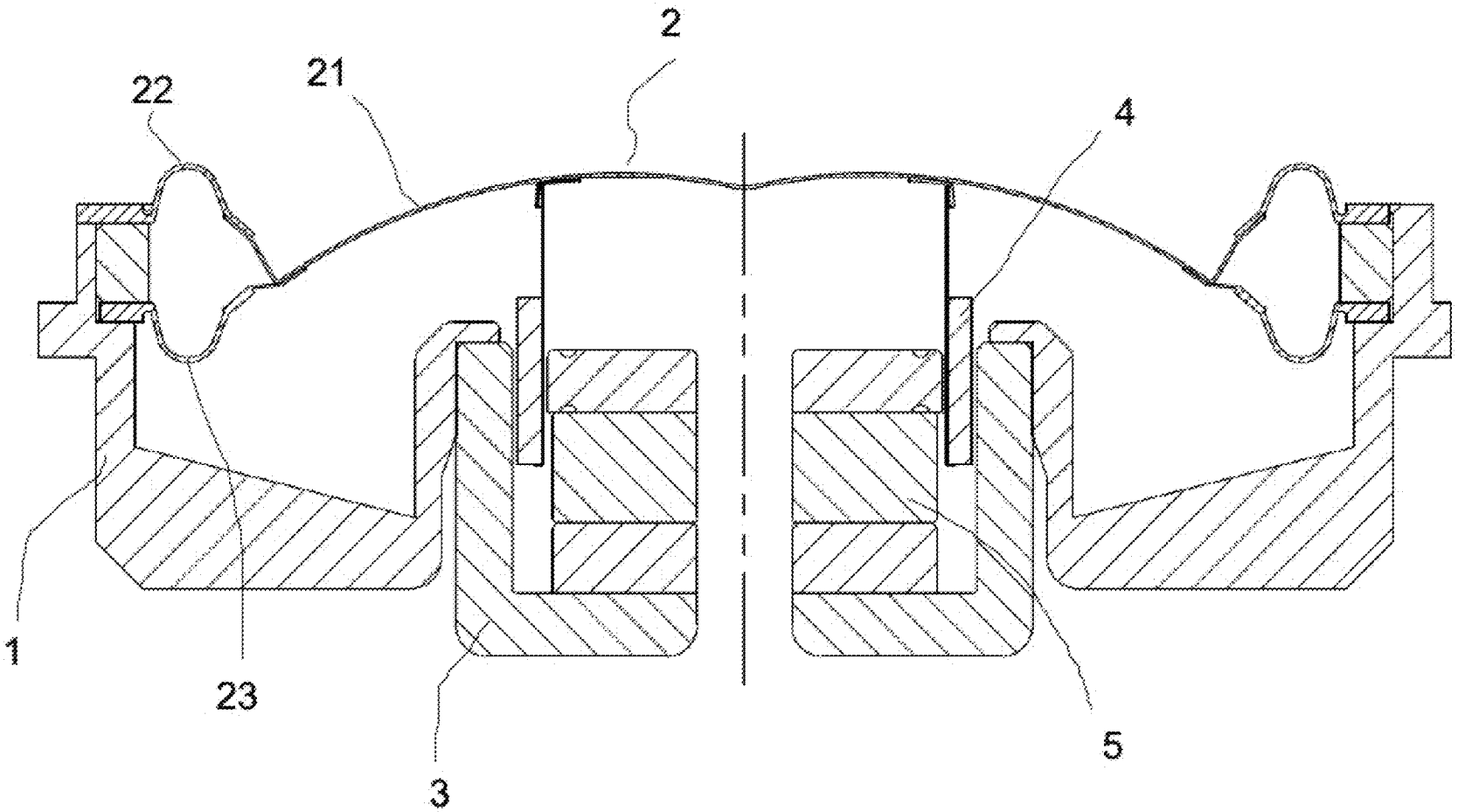
FIG. 1 is a structural section view of the symmetrical dual-edge loudspeaker according to one embodiment of the invention.
Figure 2:
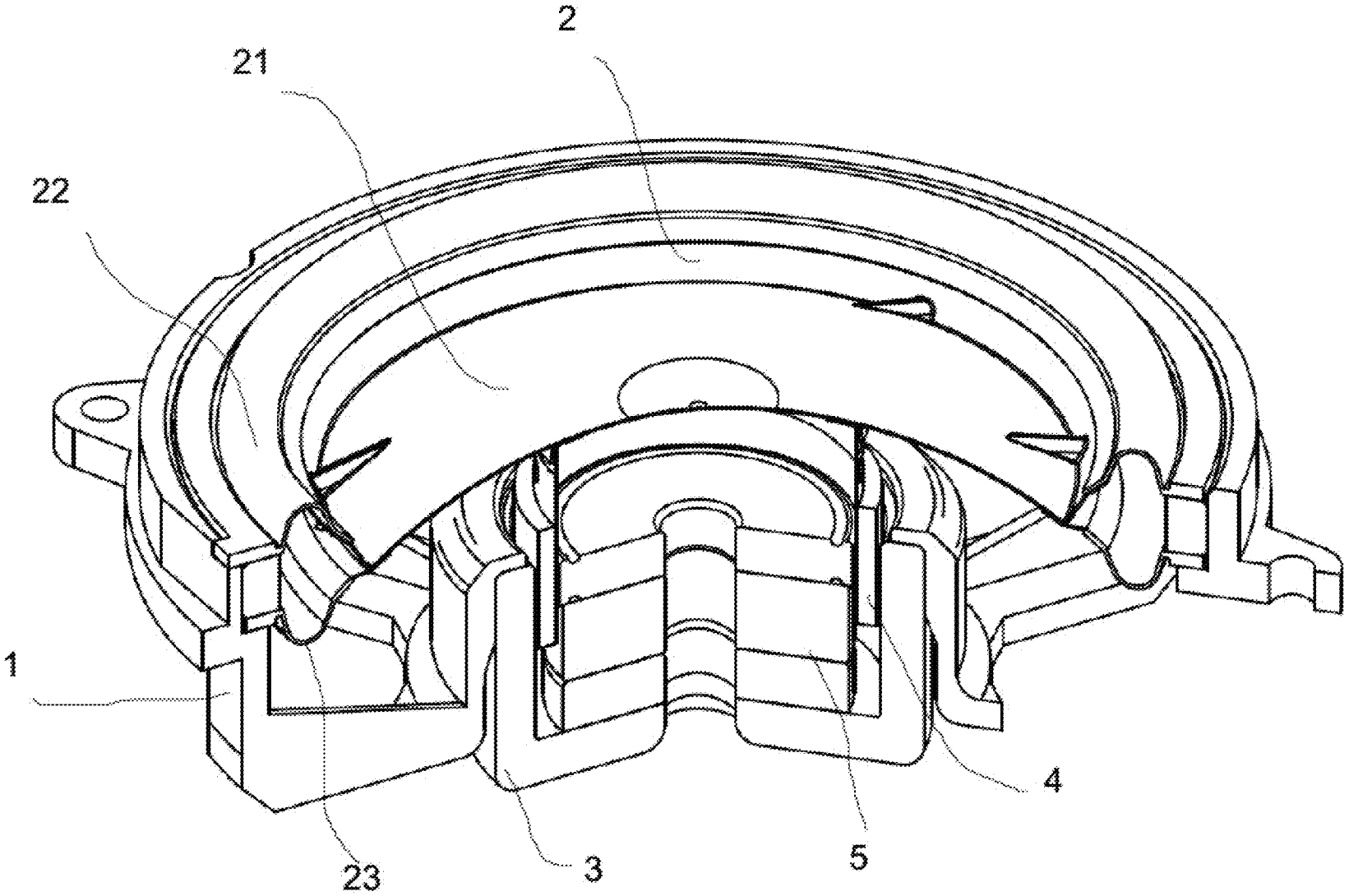
FIG. 2 is a cutaway view of the symmetrical dual-edge loudspeaker according to one embodiment of the invention.
Figure 3:
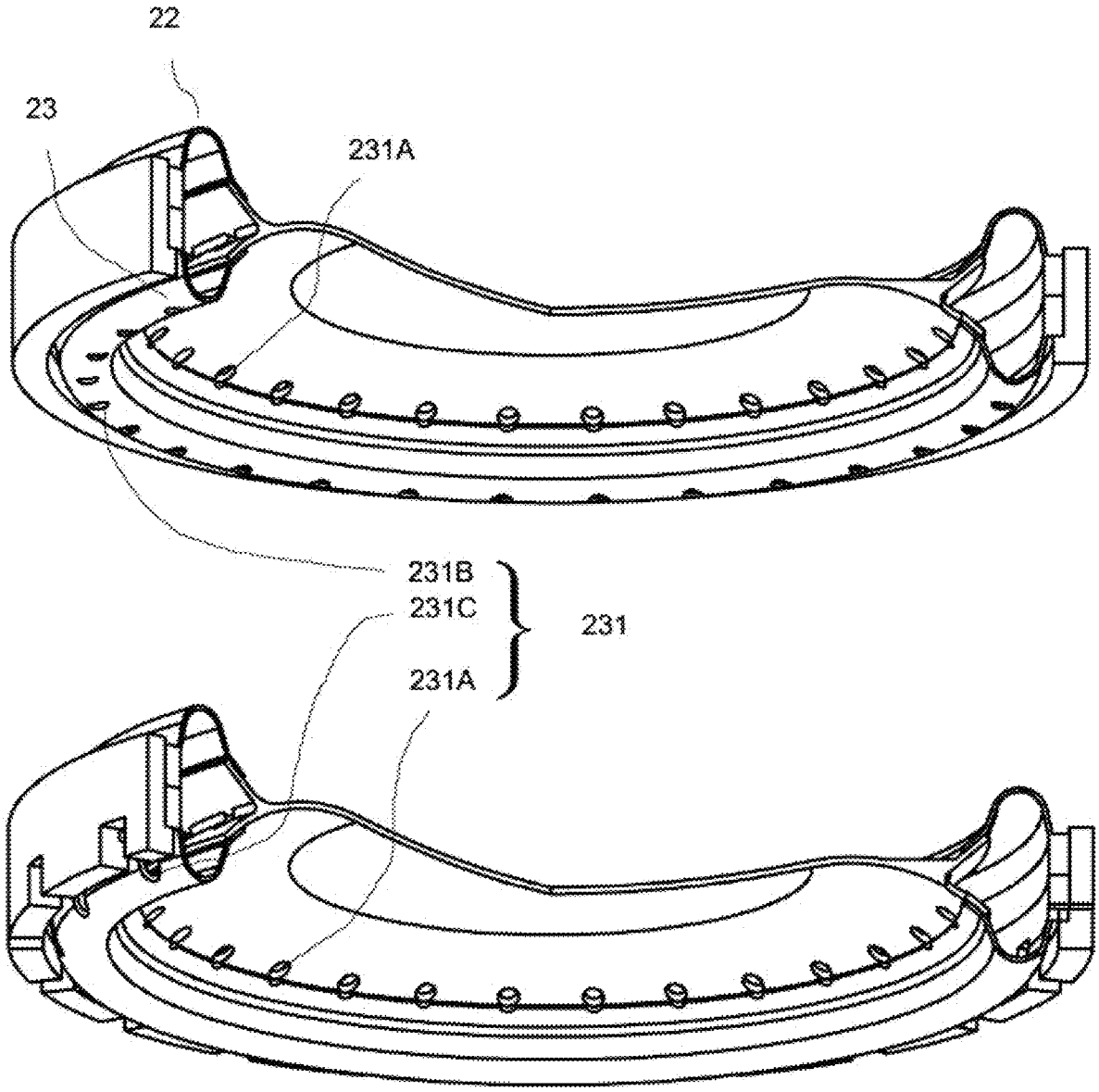
FIG. 3 is a structural schematic view of the air discharge hole disposed on the lower edge according to the invention.
Figure 4:
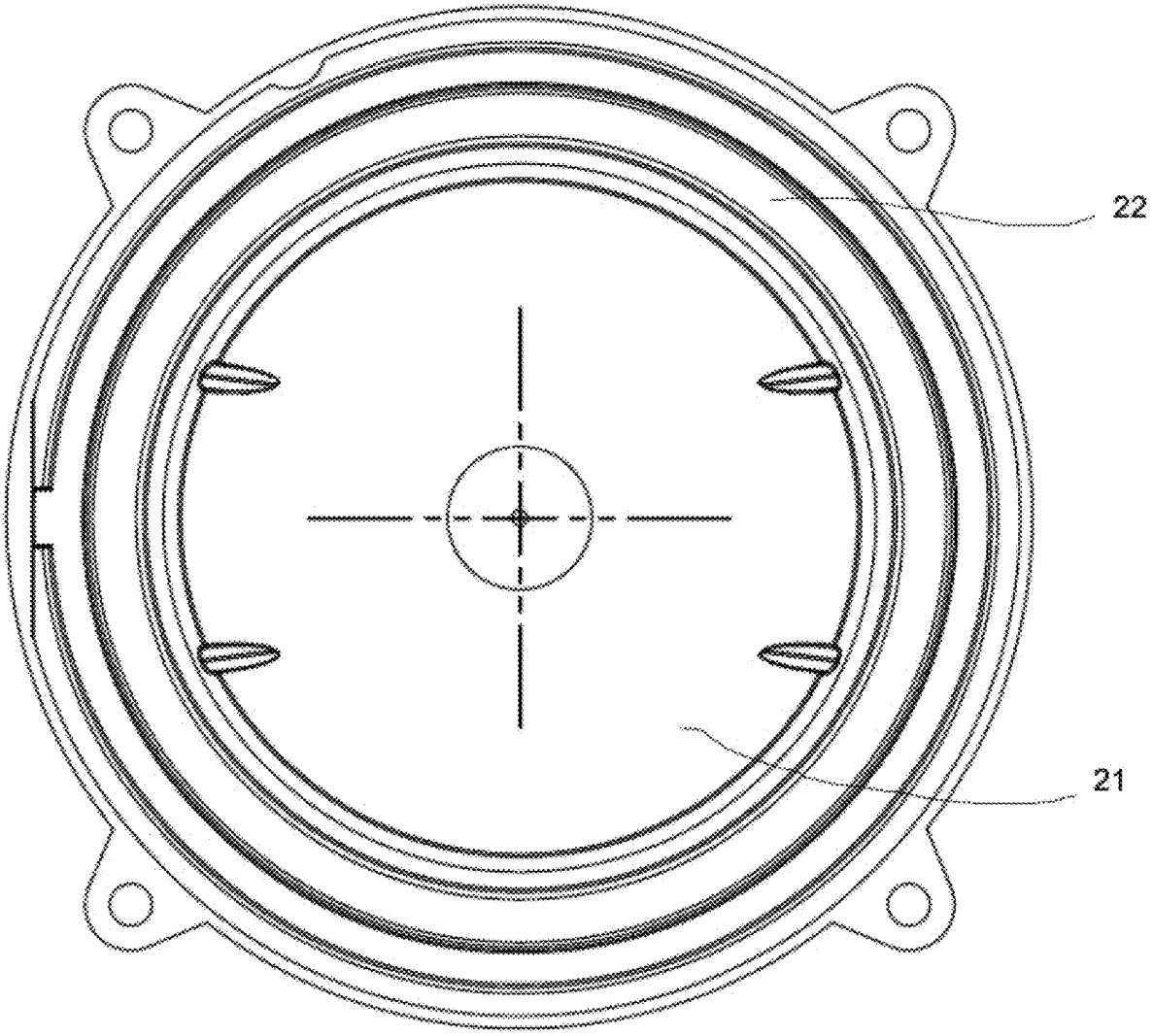
FIG. 4 is a vertical view of the symmetrical dual-edge loudspeaker according to one embodiment of the invention.

FIGS. 1, 2 and 4 respectively provide a structural section view, a cutaway view and a vertical view of the symmetrical dual-edge loudspeaker according to the invention; FIG. 3 provides a structural schematic view of the air discharge hole disposed on the lower edge according to the invention. In connection with FIG. 1-4, a symmetrical dual-edge loudspeaker, comprising a frame 1, a cone paper 2, a U-shaped magnet 3 and a voice coil 4, wherein the cone paper 2, the U-shaped magnet 3 and the voice coil 4 are mounted in the frame 1 having a support effect; an accommodation chamber is formed in the middle of the U-shaped magnet 3; the voice coil 4 is located in the accommodation chamber. A magnetic assembly 5 comprising a steel magnet and a spring washer is placed in the middle of the U-shaped magnet; the voice coil 4 is located between the U-shaped magnet 3 and the magnetic assembly.

For the vibration structure of the loudspeaker, the cone paper 2 comprises a body 21 in the middle, and an upper edge 22 and a lower edge 23 bonded to the upper and lower sides of the body 21. The upper edge 22 and the lower edge 23 are located on an edge of the body 21; the upper edge 22 protrudes upwards, with one end thereof bonded to an upper side of the body 21; the lower edge 23 protrudes downwards, with one end thereof bonded to the lower side of the body 21. In the embodiment, with the optimization design of the edge structure, the upper edge 22 and the lower edge 23 form an up-down symmetrical structure, therefore, the vibration efficiency of the cone paper 2 is effectively improved, and the stiffness coefficient Kms can be ensured to achieve optimal symmetry.

The shape of the upper edge 22 and the lower edge 23 is a ring, a triangle, a square or a polygon, and can be adjusted according to the shape of the loudspeaker. In the embodiment, the upper edge 22 and the lower edge 23 are configured to have a protruding ring structure. The other ends of the upper edge 22 and the lower edge 23 are respectively fixedly connected to the frame 1, so as to connect the cone paper 2 to the frame.

As shown in FIG. 3, the lower edge 23 is provided with an air discharge hole 231. In the embodiment, the lower edge 23 is provided with an air discharge hole 231 at the following positions respectively: an air discharge hole 231A is disposed on one side adjacent to the body 21; an air discharge hole 231B is disposed in the middle on the lower side of the lower edge; and an air discharge hole 231C is disposed on one side away from the body 21.

The cone paper 1 and the body 21 can be made into an integrated structure or a split structure according to a process requirement. In the embodiment, the body 21 is a split structure.

Embodiment 2

Figure 5:
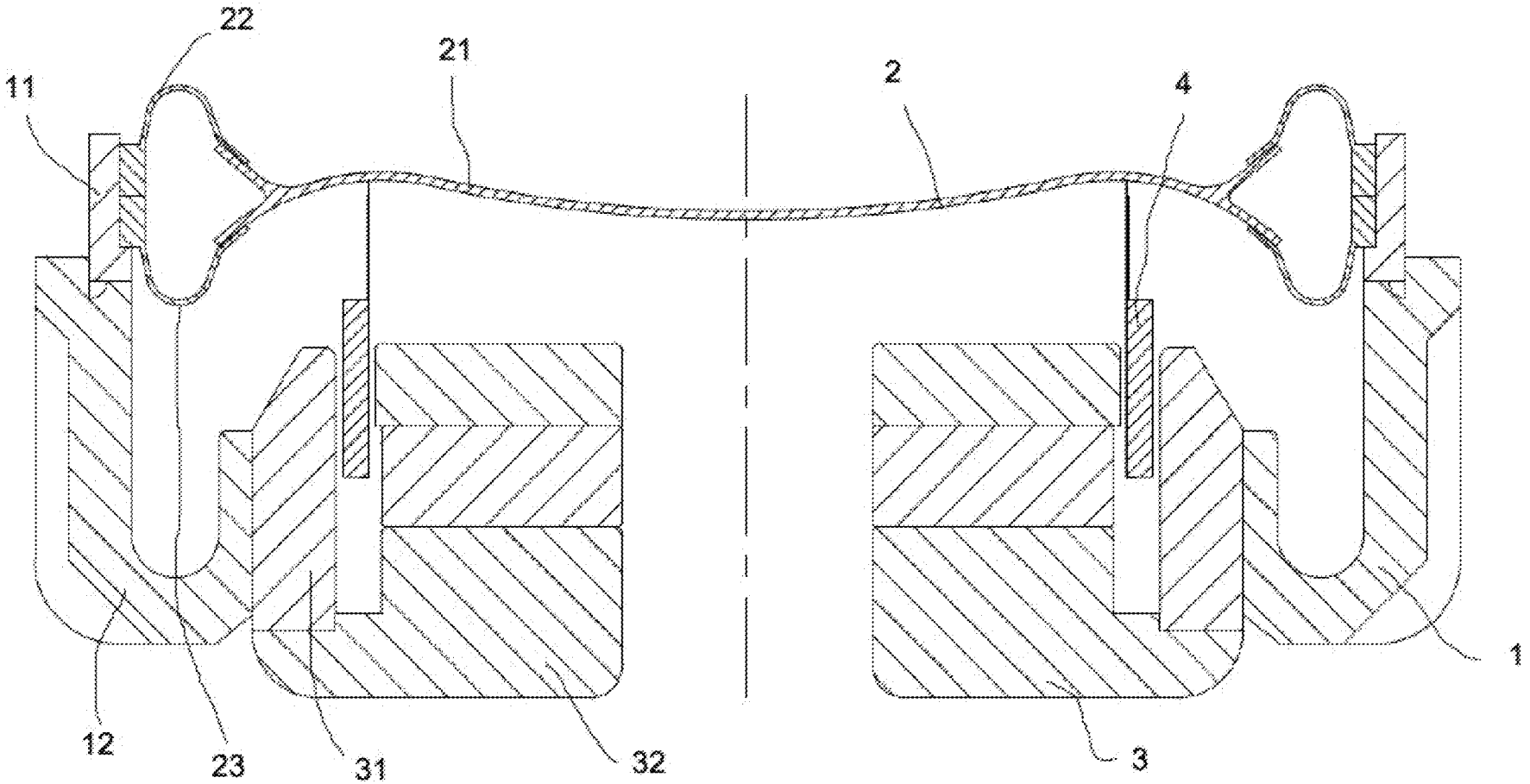
FIG. 5 is a structural section view of the symmetrical dual-edge loudspeaker according to another embodiment of the invention.

FIG. 5 shows a structural section view of the symmetrical dual-edge loudspeaker according to another embodiment of the invention. As shown in FIG. 5, the body 21 of the loudspeaker is an integrated structure, and extends from the edges thereof Y-shaped connecting surfaces for bonding to the upper edge and the lower edge.

The frame 1 comprises an upper frame portion 11 and a lower frame portion 12, wherein the upper edge 22, the lower edge 23 and the upper frame portion 11 are integrally formed, contact each other at the lateral surfaces of the edges, thus the installation size of the loudspeaker can be reduced.

The U-shaped magnet is in a split structure, and comprises a peripheral portion 31 and a central portion 32, wherein the peripheral portion 31 and the lower frame portion 12 are integrally injection-molded, and then the peripheral portion 31 is assembled in the central portion 32, thus the requirement for the assembly process is satisfied.

Embodiment 3

The stiffness coefficient Kms and total harmonic distortion (THD) parameter of a conventional GBS loudspeaker (3.51N) and the symmetrical dual-edge loudspeaker of the invention are respectively tested. The results are as shown in FIG. 6 which is a Kms curve diagram of the GBS loudspeaker and the symmetrical dual-edge loudspeaker and FIG. 7 which is a THD comparison curve diagram of the GBS loudspeaker and the symmetrical dual-edge loudspeaker.

Figure 6A:
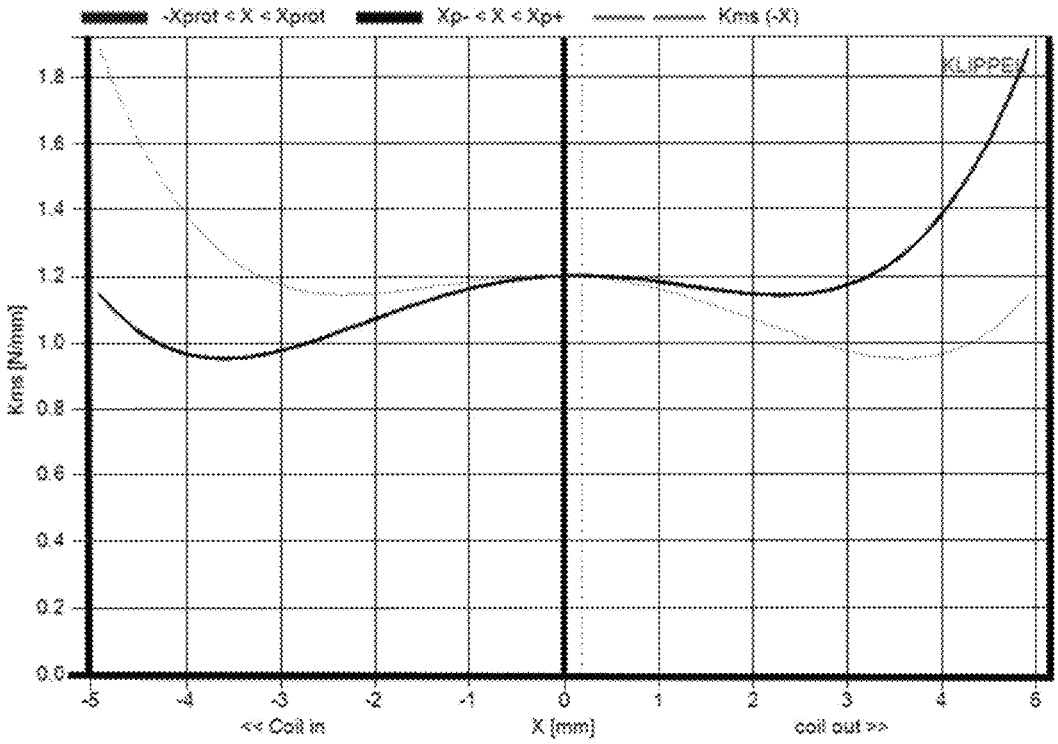
FIG. 6 is a Kms curve diagram of a GBS loudspeaker and the symmetrical dual-edge loudspeaker.
Figure 6B:
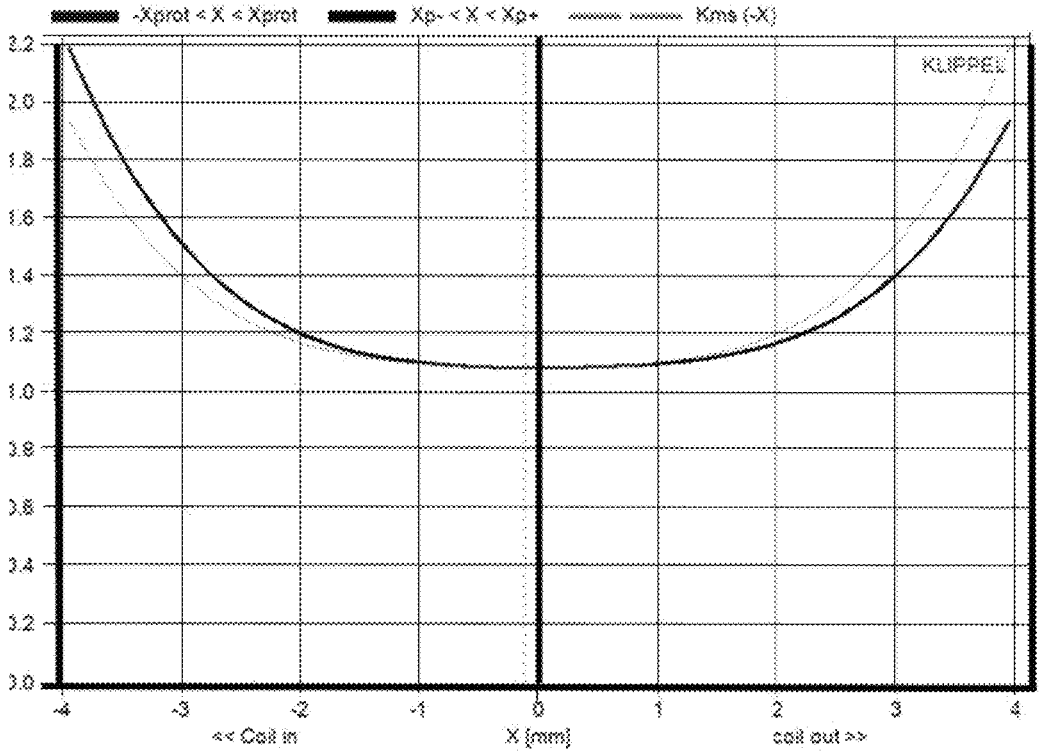
Figure 7:
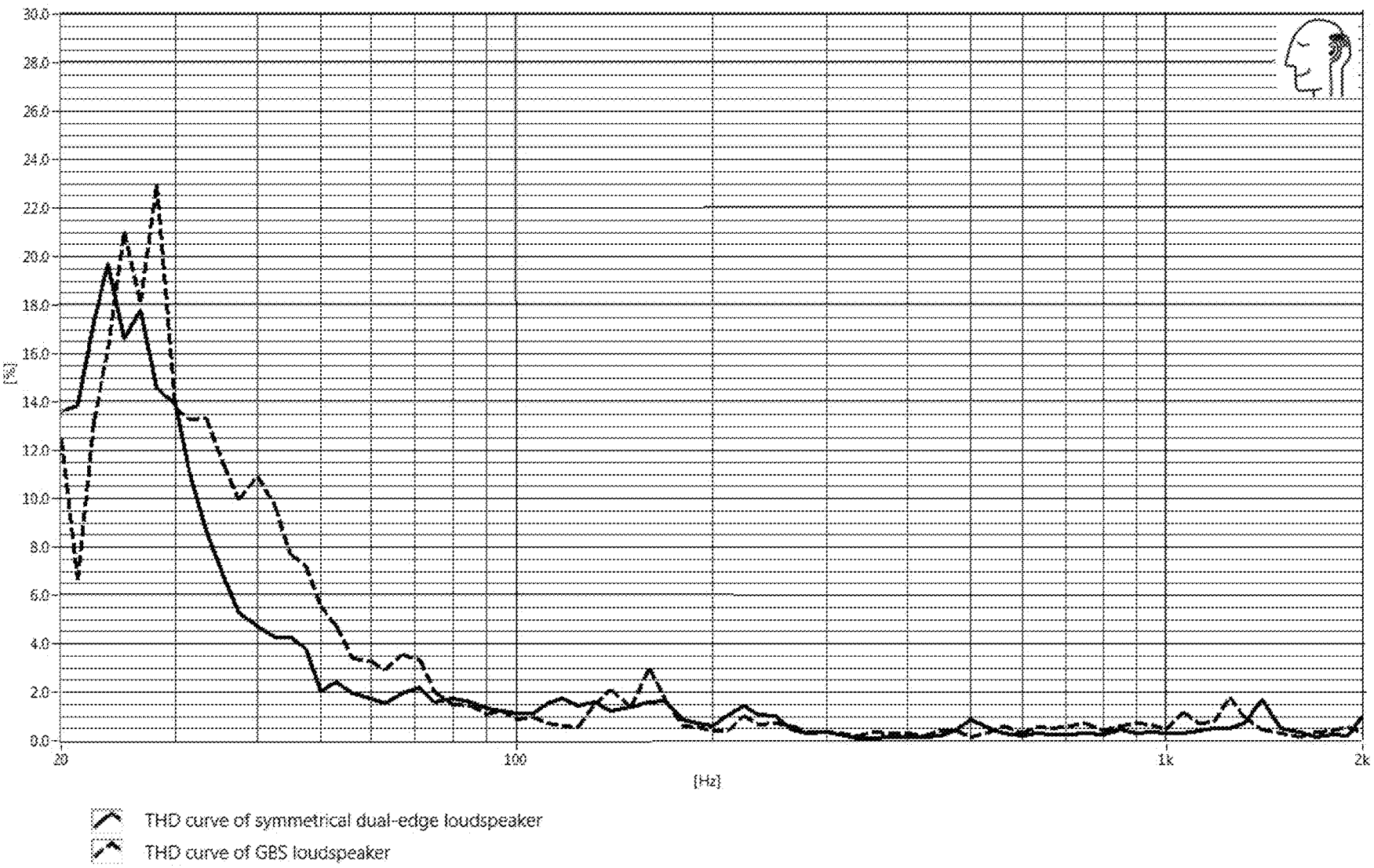
FIG. 7 is a THD comparison curve diagram of the GBS loudspeaker and the symmetrical dual-edge loudspeaker.

It can be seen from FIGS. 6 and 7 that the symmetrical dual-edge loudspeaker provided by the invention designs an extraordinarily symmetrical signal parameter Kms which fully reflects that the loudspeaker has a very good up-down motion feature. In addition, for the THD parameter, the THD of the symmetrical dual-edge loudspeaker is in the interval of 30-70 Hz which is obviously lower than that of the GBS loudspeaker with a damper.

In summary, the invention effectively ensures steady up and down motion of the cone paper in a limited suspension space by disposing up-down symmetrical upper and lower edges, and enables the stiffness coefficient Kms to achieve optimal symmetry, thus satisfying an application requirement for an ultra-thin loudspeaker.

The content above is only examples and illustrations to the structure of the invention, but should not be considered as a limitation to the protection scope of the invention patent because of the specific and detailed description thereof. It should be pointed out that a person skilled in the art could make various variations and improvements without departing from the concept of the invention. And the obvious substitutions are all concluded in the protection scope of the invention.

The invention claimed is:

1. A symmetrical dual-edge loudspeaker, comprising:

a frame; and a cone paper;

a U-shaped magnet;

an accommodation chamber in a middle of the U-shaped magnet; and a voice coil mounted in the frame and located in the accommodation chamber, wherein the cone paper comprises a body, and an upper edge and a lower edge bonded to an upper end and a lower end extending from an extended part of the body, wherein the upper edge and the lower edge respectively and symmetrically protrude upwards and downwards from the extended part of the body in a cross section, wherein the cone paper is fixedly connected to the frame via the upper edge and the lower edge, and wherein the lower edge is provided with an air discharge hole.

2. The symmetrical dual-edge loudspeaker according to claim 1, wherein the position on the lower edge at which the air discharge hole is disposed comprises: one side of the lower edge adjacent to the body, a middle section of the lower edge or one side of the lower edge adjacent to the frame.

3. The symmetrical dual-edge loudspeaker according to claim 2, wherein the shape of the upper edge and the lower edge is a ring, a triangle, a square or a polygon.

4. The symmetrical dual-edge loudspeaker according to claim 1, wherein the body is an integrated structure or a split structure.

5. The symmetrical dual-edge loudspeaker according to claim 4, wherein the shape of the upper edge and the lower edge is a ring, a triangle, a square or a polygon.

6. The symmetrical dual-edge loudspeaker according to claim 1, wherein the frame comprises an upper frame portion and a lower frame portion; the upper edge, the lower edge and the upper frame portion are integrally formed.

7. The symmetrical dual-edge loudspeaker according to claim 6, wherein the shape of the upper edge and the lower edge is a ring, a triangle, a square or a polygon.

8. The symmetrical dual-edge loudspeaker according to claim 1, wherein the U-shaped magnet comprises a peripheral portion in a split structure and a central portion; the peripheral portion and the lower frame portion are integrally injection-molded.

9. The symmetrical dual-edge loudspeaker according to claim 8, wherein the shape of the upper edge and the lower edge is a ring, a triangle, a square or a polygon.

10. The symmetrical dual-edge loudspeaker according to claim 1, wherein the shape of the upper edge and the lower edge is a ring, a triangle, a square or a polygon.

* * * * *